US010226085B2

(12) United States Patent
Loyens

(10) Patent No.: US 10,226,085 B2
(45) Date of Patent: Mar. 12, 2019

(54) PROTECTIVE ATHLETIC PANT

(71) Applicant: BASE360 Inc., Ottawa (CA)

(72) Inventor: Rolf Loyens, Ottawa (CA)

( * ) Notice: Subject to any disclaimer, the term of this patent is extended or adjusted under 35 U.S.C. 154(b) by 95 days.

(21) Appl. No.: 15/127,845

(22) PCT Filed: Mar. 20, 2015

(86) PCT No.: PCT/CA2015/050217
§ 371 (c)(1),
(2) Date: Sep. 21, 2016

(87) PCT Pub. No.: WO2015/139143
PCT Pub. Date: Sep. 24, 2015

(65) Prior Publication Data

US 2017/0079342 A1 Mar. 23, 2017

Related U.S. Application Data

(60) Provisional application No. 61/968,549, filed on Mar. 21, 2014.

(30) Foreign Application Priority Data

Aug. 29, 2014 (CA) ..... 2861368

(51) Int. Cl.
*A41D 1/06* (2006.01)
*A41D 13/02* (2006.01)
(Continued)

(52) U.S. Cl.
CPC ..... *A41D 13/0543* (2013.01); *A41D 1/08* (2013.01); *A41D 13/0015* (2013.01);
(Continued)

(58) Field of Classification Search
CPC .. A41D 13/0543; A41D 1/08; A41D 13/0015; A41D 13/0506; A41D 13/0523;
(Continued)

(56) References Cited

U.S. PATENT DOCUMENTS 4,280,342 A * 7/1981 Eng ..... D04B 21/14 2/16
4,470,156 A * 9/1984 Duerbeck ..... A41D 1/08 2/227
(Continued)

FOREIGN PATENT DOCUMENTS

CA 2695081 C 1/2009
CA 2749043 C 7/2010
CA 2841799 C 1/2013

OTHER PUBLICATIONS

International Search Report and Written Opinion for International Patent Application No. PCT/CA2015/050217 dated Jun. 1, 2015.
(Continued)

*Primary Examiner* — Jameson D Collier
(74) *Attorney, Agent, or Firm* — Brion Raffoul

(57) ABSTRACT

The present invention provides protective athletic pants that are constructed from a protective material and a flexible material, in optimal ratios. This invention provides durable pants that provide adequate protection without unduly restricting the movement of the wearer.

13 Claims, 5 Drawing Sheets

(51) Int. Cl.

| | |
|---|---|
| ***A41D 13/00*** | (2006.01) |
| ***A41D 13/06*** | (2006.01) |
| ***A41D 13/05*** | (2006.01) |
| ***A41D 31/00*** | (2019.01) |
| ***A41D 1/08*** | (2018.01) |
| ***A63B 71/12*** | (2006.01) |

(52) U.S. Cl.
CPC ..... *A41D 13/0506* (2013.01); *A41D 13/0525* (2013.01); *A41D 13/0537* (2013.01); *A41D 13/065* (2013.01); *A41D 31/0055* (2013.01); *A63B 71/1225* (2013.01); *A41D 2600/10* (2013.01); *A41D 2600/20* (2013.01); *A63B 2071/125* (2013.01); *A63B 2071/1233* (2013.01); *A63B 2071/1241* (2013.01); *A63B 2071/1258* (2013.01); *A63B 2071/1266* (2013.01); *A63B 2071/1275* (2013.01)

(58) Field of Classification Search
CPC ..... A41D 13/0537; A41D 13/065; A41D 31/0055; A41D 2600/10; A41D 2600/20; A41D 13/05; A41D 13/0593; A41D 13/0575; A41D 1/067; A41D 31/005; A63B 71/1225; A63B 2071/1233; A63B 2071/1241; A63B 2071/125; A63B 2071/1258; A63B 2071/1266; A63B 2071/1275
USPC ..... 2/22, 23, 79, 2.5, 227, 228, 267
See application file for complete search history.

(56) References Cited

U.S. PATENT DOCUMENTS 4,810,559 A * 3/1989 Fortier ..... A41D 13/0156 156/232
5,210,877 A * 5/1993 Newman ..... A41D 1/067 2/115
5,343,564 A * 9/1994 Reynolds ..... A41D 13/001 2/236
5,634,215 A * 6/1997 DeBaene ..... A41D 1/067 2/227
5,689,836 A 11/1997 Fee et al.
7,496,973 B2 * 3/2009 Jewell ..... A41D 13/0581 2/227
7,500,274 B1 * 3/2009 Kallen ..... A41D 1/086 2/227
7,533,423 B2 * 5/2009 Rudolph ..... A41D 1/086 2/227
8,407,813 B2 * 4/2013 Grilliot ..... A41D 1/067 2/227
2005/0000002 A1 * 1/2005 Levy ..... A41D 1/08 2/244
2006/0230503 A1 * 10/2006 Shterenberg ..... A41F 9/00 2/309
2007/0204378 A1 * 9/2007 Behar ..... A41D 13/01 2/69
2009/0293167 A1 12/2009 Kottler
2010/0325766 A1 * 12/2010 Mackintosh ..... A41D 13/00 2/22
2012/0005798 A1 * 1/2012 Schatten ..... A41D 13/0015 2/23
2012/0017345 A1 * 1/2012 Stensgaard ..... A41D 13/0543 2/24
2012/0117700 A1 * 5/2012 Howell ..... A41B 1/08 2/2.5
2012/0117705 A1 * 5/2012 Hawkins ..... A41F 9/00 2/23
2012/0131729 A1 * 5/2012 Hernandez ..... A41D 13/065 2/410
2014/0115747 A1 * 5/2014 Spruill ..... A41D 13/0015 2/22
2014/0208492 A1 * 7/2014 Foley ..... A41D 13/015 2/459
2014/0215679 A1 * 8/2014 Habip ..... A41D 13/0506 2/23
2014/0325730 A1 * 11/2014 Robinson ..... A41D 13/015 2/23
2015/0196070 A1 * 7/2015 Burger ..... A41D 1/08 2/465

OTHER PUBLICATIONS

Office Action for Canadian Patent No. 2,861,368 dated Nov. 7, 2014.

* cited by examiner

PROTECTIVE ATHLETIC PANT

FIELD OF THE INVENTION

This invention relates to the field of protective equipment. More specifically, this invention relates to apparel that provides protection and flexibility during sports and other physically demanding activities.

BACKGROUND

Sports such as hockey, figure skating and speed skating involve the use of sharp blades to skate across rinks at high velocities. The combination of sharp blade edges and high velocities can lead to gruesome injuries that can end an athlete's career. Many of these injures may be avoidable through the proper use of protective equipment.

For instance, in hockey, an injury may occur when a player's skate inadvertently hits another player's leg in an area that is not protected by a pad. As an example, a typical goalie leg pad covers only the front and sides of a leg, leaving the back of the leg unprotected. If a player accidentally slices the exposed back area of a goalie's leg with his skate, the goalie can suffer a debilitating injury from a laceration caused by the skate's blade.

There is also the requirement in some sports and activities to provide protection against other types of lacerations and abrasion injuries that result from the environment or friction during a fall or slide as in skiing, cycling, football or soccer.

Some protective equipment known in the art attempt to provide increased protection to the users of such equipment. However, because of the demands of the sport and of the users, much of the current protective equipment tend to focus on becoming lightweight and less cumbersome to wear.

Unfortunately, this has led to the shortening of various dimensions of the equipment and the attendant exposure of more body parts to harm. Other protective equipment may provide adequate protection, but at the cost of being bulky and heavy. Such bulky and heavy equipment can be uncomfortable, especially in hot temperatures. There is therefore a need to mitigate if not overcome the shortcomings of the prior art and to, preferably, provide maximized protective coverage using a lightweight material that is breathable and which does not restrict flexibility.

SUMMARY OF THE INVENTION

The present invention provides protective athletic pants that are constructed from a protective material and a flexible material, in optimal ratios. This invention provides durable pants that provide adequate protection from abrasion, cuts and punctures without unduly restricting the user's mobility.

In a first aspect, the present invention provides a pair of protective pants comprising:

a front portion and a rear portion coupled to each other;

a waistband portion located at upper ends of the front portion and the rear portion, the waistband portion forming an opening at a top side of the protective pant;

a pair of elongated tubular pant legs extending from the waistband portion, each of the elongated tubular pant legs having an outer side, an inner side, and an open end opposite to the waistband portion, the outer side extending downwardly from the waistband portion and connecting to the open end opposite to the waistband portion, the inner side extending upwardly from the open end opposite to the waistband portion and connecting to the inner side of the other elongated tubular pant leg at a groin portion;

wherein the pair of protective pants is constructed from a flexible material and a protective material;

the protective material is affixed to the flexible material as protective panels;

the protective material covers a maximum of 85% of a surface area of said pair of pants.

BRIEF DESCRIPTION OF THE DRAWINGS

The embodiments of the present invention will now be described by reference to the following figures, in which identical reference numerals in different figures indicate identical elements and in which.

Figure 1:
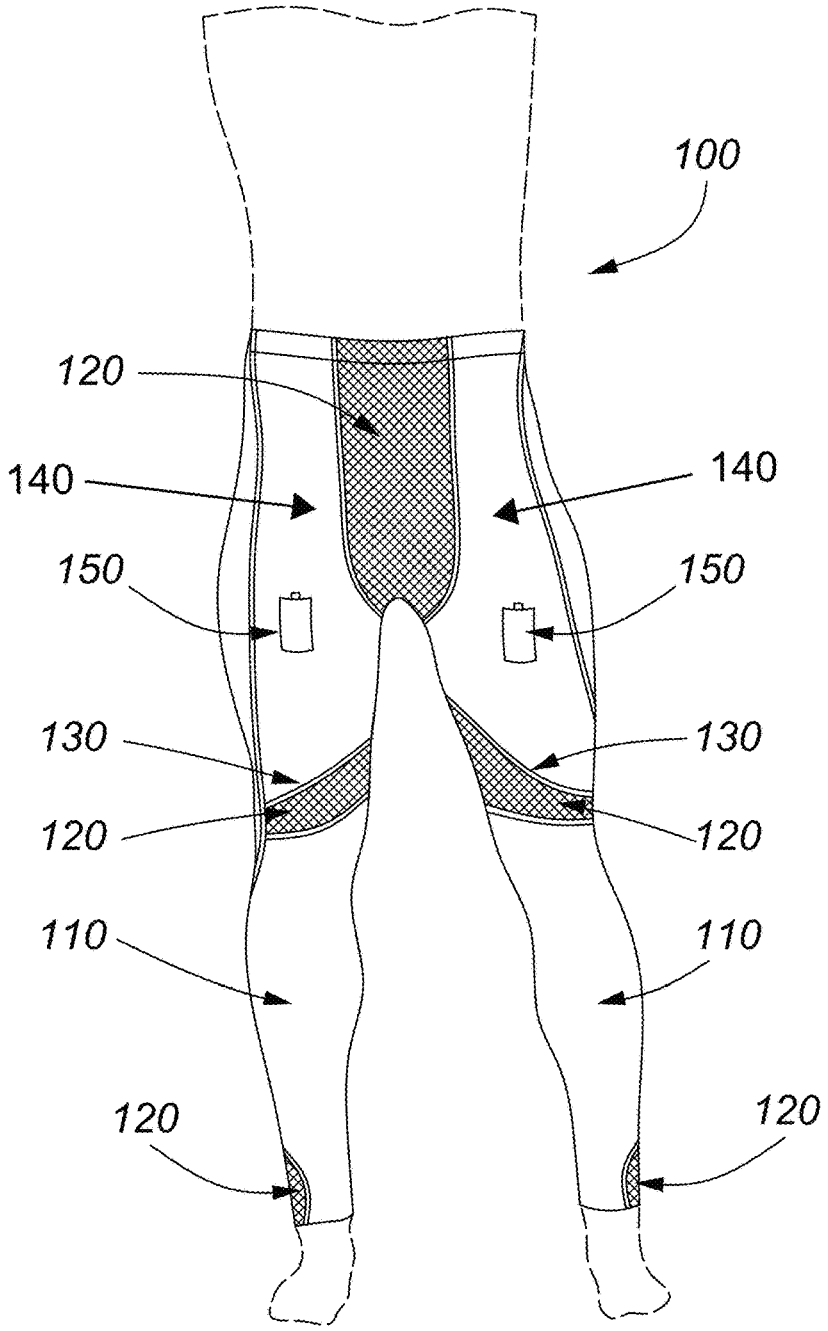
FIG. 1 is a front view of the protective pants according to one embodiment of the present invention.

The Figures are not to scale and some features may be exaggerated or minimized to show details of particular elements while related elements may have been eliminated to prevent obscuring novel aspects. Therefore, specific structural and functional details disclosed herein are not to be interpreted as limiting but merely as a basis for the claims and as a representative basis for teaching one skilled in the art to variously employ the present invention.

DETAILED DESCRIPTION

The terms "coupled" and "connected", along with their derivatives, may be used herein. It should be understood that these terms are not intended as synonyms for each other. Rather, in particular embodiments, "connected" may be used to indicate that two or more elements are in direct physical contact with each other. "Coupled" may be used to indicated that two or more elements are in either direct or indirect (with other intervening elements between them) physical contact with each other, or that the two or more elements co-operate or interact with each other (e.g. as in a cause and effect relationship).

The present invention provides athletic pants that provide effective protection against abrasion and lacerations to areas of the lower body. The pants are constructed from a protective material and a flexible material. The pants are generally constructed from the flexible material with the protective material being strategically placed to protect areas that are not otherwise protected by traditional sports equipment. The protective material is also ergonomically shaped to fit the contour of a user's muscles, thereby providing significant protection and comfort. The combination of the protective material and the flexible material ensures that the pants provide adequate protection without negatively affecting the user's performance or mobility.

The present invention contemplates protective pants made from natural or synthetic flexible material, with the flexible materials acting as a base layer for the pants. Protective material is then incorporated into the structure of the pants by preferably coupling the protective material to either the inner side or the outer side of the flexible material. A person skilled in the art will appreciate that there are numerous ways to couple various pieces of fabric, including, but not limited to, stitching, hook-and-loop fasteners, glue, and buttons. As an alternative, the protective material may be implemented as protective panels. These protective panels may be sandwiched between panels of flexible material. These protective panels within the pouches formed by the flexible material may be user removable/configurable or may be implemented as being sealed from user intervention.

In one implementation, a pair of athletic pants are first constructed using flexible material made from a combination of synthetic or natural fibers including stretchable fibers such as Spandex or elastane. The flexible material is constructed from the combination of fibers to provide tensile strength, stretch capabilities, and memory. The percentages or ratios between the stretchable fibers and the synthetic or natural fibers may be dependent on the projected use of the garment. Once the athletic pants are constructed, specifically contoured and shaped panels made from an abrasion/laceration-resistant protective material are then applied and attached to the athletic pants at specific areas. These specific areas may be dependent on the sport or activity for which the athletic pants are to be used. As an example, for a hockey-specific pair of athletic pants, protective panels may be applied to the back of the lower leg as this region is generally not covered by hockey protective equipment. Other sports may require protective panels at other locations on the athletic pants. As noted above, the protective panels may be attached to the athletic pants using a variety of methods. As noted above, the protective panels may, in some embodiments, be user removable or they may be stitched to form a non-separable part of the athletic pants.

Referring now to FIG. 1, the pants 100 are comprised of a flexible material 110 and a protective material 120. As can be seen from FIGS. 1 and 2, the pants have a front portion and a rear portion that are coupled to each other. There is a waistband portion located at upper ends of the front portion and the rear portion, with the waistband portion forming an opening at a top side of the pants. The pants also have a pair of elongated tubular pant legs extending from the waistband portion. Each of the elongated tubular pant legs has an outer side, an inner side, and an open end opposite to the waistband portion, with the outer side extending downwardly from the waistband portion and connecting to the open end opposite to the waistband portion. The inner side of each leg extends upwardly from the open end opposite to the waistband portion and connects to the inner side of the other elongated tubular pant leg at a groin portion.

The protective material 120 is positioned over areas or regions that would not otherwise be protected by traditional equipment when this equipment is worn. As an example, in the embodiment illustrated in FIG. 1, protective material is located above the knee and over the groin area. The protective material 120 located above the knee follows the area above the knee and up to the groin, strategically following the route of the femoral artery. By covering the inside of the groin and following the femoral artery, the pants 100 provide further protection to the arteries as well as to muscle and soft tissue. Also, by shaping the protective material 120 to follow the femoral artery, a greater area is left on the upper portion of the pants to only be covered by the flexible material 110. This provides greater mobility to the hamstring and quadriceps as the movements of these muscles are restricted only by the flexible material 110 and not by the less flexible protective material.

In another embodiment of the present invention, the protective material 120 located above the knee is joined to the protective material 120 located over the groin. The sections of protective material may be joined to form a single section of protective material or the different sections may be joined by other connecting means. Joining the groin and knee areas in this way provides a natural anchor that works in unison to keep the muscles aligned.

It should be noted that, in a further embodiment of the present invention, the protective material 120 located around the knee area covers the entire front, back and sides of the knee area. This provides protection to the complete knee area from abrasion, lacerations, cuts, and punctures.

As shown in FIG. 1, the protective material 120 is coupled to the flexible material 110 at seams 130 found at the interface between the protective material 120 and the flexible material 110. The seams and the protective material 120 are designed such that the protective material 120 adopts a shape that fits or follows the muscle contour of the user. As shown, the seams follow the outer boundaries of the protective material 120. The seams also provide a space 140 around the protective material 120 that provides additional flexibility to the pants, ensuring that the elasticity and stretch of the flexible material 110 are not compromised. Furthermore, by allowing space between the seams of the protective material and the seams of the garment, this ensures that the flexibility and performance of the flexible fabric are maintained. In this embodiment, the protective material may be joined to the flexible material at the seams by stitching or the protective material may be glued to the flexible material.

It is worth noting that another aspect of the present invention is that the regions not covered by the protective material are covered by the flexible material. The size and placement of these regions covered by the flexible material will, of course, vary throughout the pants as the protective material is selectively placed to protect specific muscles, muscle groups, and vulnerable body parts. As an example, in FIG. 1 it can be seen that the knee area and the groin area are both covered by the protective material. The region between these covered areas is covered by the flexible material. This allows for flexibility of movement for the user's specific muscles and joints while protecting the critical areas with the protective material 120.

Figure 2:
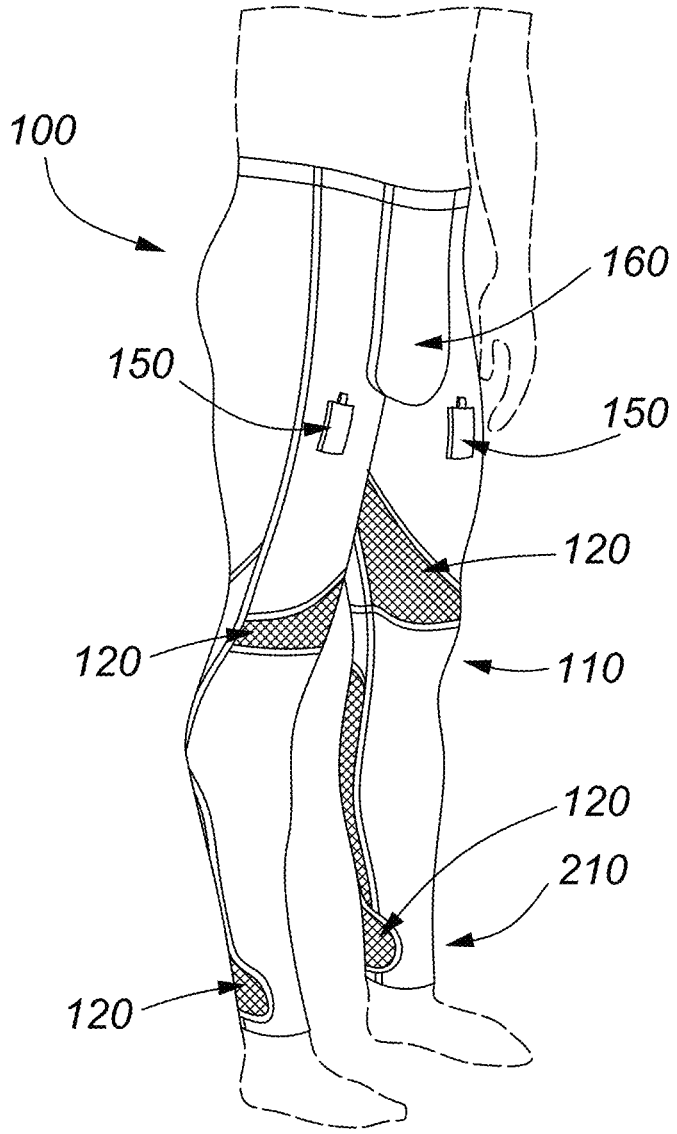
FIG. 2 is a perspective view of the protective pants according to another embodiment of the present invention.

FIG. 2 shows a perspective view of the protective pants 100 according to another embodiment of the present invention. As shown in FIG. 2, protective material 120 covers most of the ankle area 210 of the user. As further shown in FIG. 2, the protective material 120 that covers the ankle area 210 of the user does not fully enclose the ankle area 210. There is a break in protective material, with flexible material 110 covering the gap between the two ends of the protective material 120 which wrap around the back of the ankle area 210. The cuff or edge of the pants 100 is therefore constructed of a combination of the flexible material and the protective material. The region encircling the back of the ankle (just above the heel) is therefore constructed from the protective material while the region covering the front of the ankle is constructed from the flexible material. This embodiment of the present invention allows a wearer to easily put on and take off the pants 100, as the cuff of the pants 100 will expand as the user puts on the pants 100. An alternative embodiment of the invention is a pair of pants that have a pouch 160 to protect the groin area. Another alternative embodiment of the invention is a pair of pants that have at least one hook-and-loop fastener 150.

An alternative embodiment of the invention is pants that have protective material 120 that wraps around the entire circumference of the ankle area 210. Although this embodiment provides a greater degree of protection of the ankle area 210, the flexibility of the ankle area 210 of the pants 100 will be more restricted.

Figure 3:
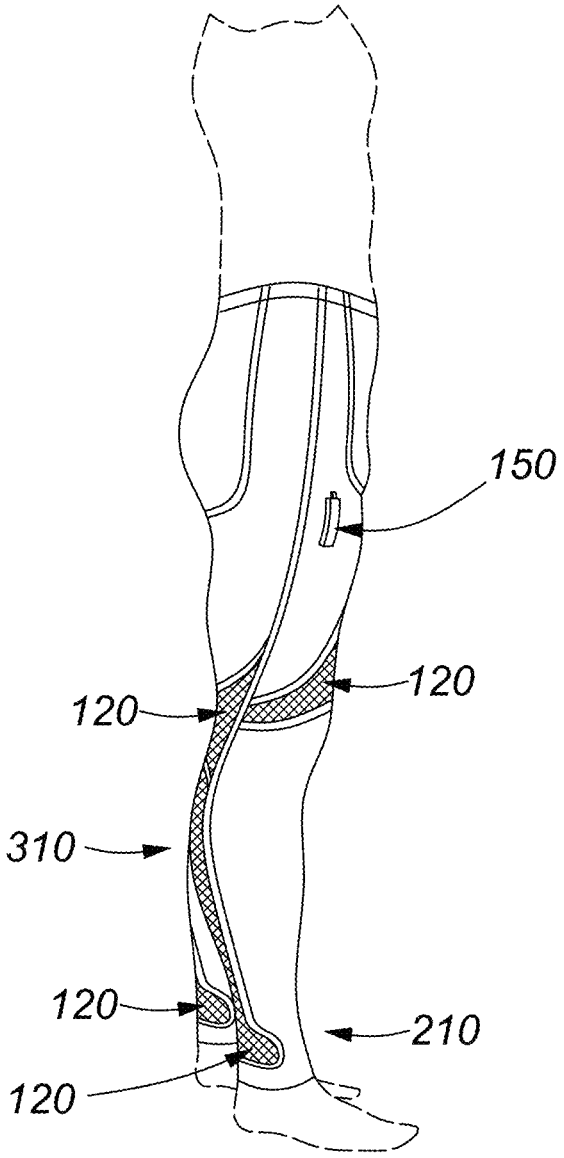
FIG. 3 is a side view of the protective pants according to a further embodiment of the present invention.

FIG. 3 shows yet another embodiment of the present invention. This embodiment includes protective material 120 that wraps around the sides and back of the ankle area 210 of the wearer, and extends up the leg to cover the calf area 310 of the wearer. The protection of the calf area 310 will be better understood with reference to FIG. 4.

Figure 4:
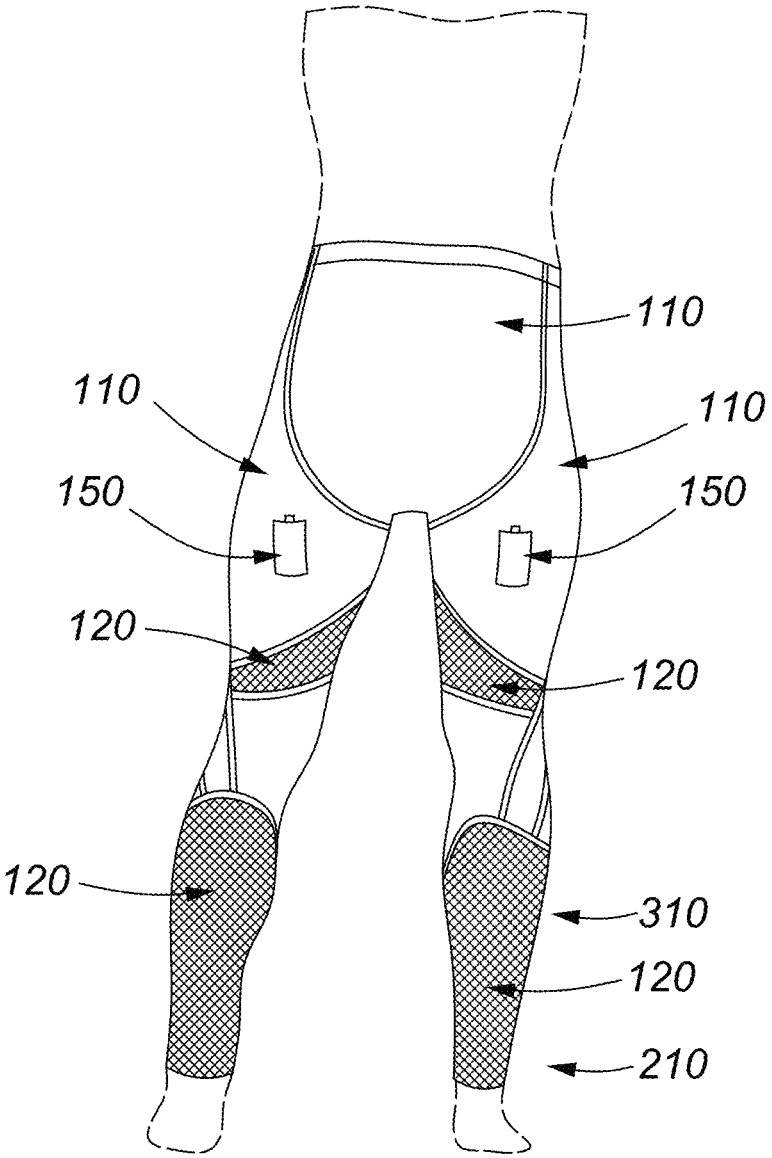
FIG. 4 is a back view of the protective pants according to another embodiment of the present invention.

FIG. 4 shows a back view of one embodiment of the present invention. As shown in FIG. 4, the protective material 120 covering the calf area 310 of the wearer follows the contour of the leg, being wider at the top of the calf area 310 (the region of the top of the gastrocnemius muscle) and tapering down to the bottom of the calf area 310 (to the region of the Achilles tendon), then expanding once again to cover the sides of the ankle area 210. This provides several benefits in the wearing and manufacturing of the pants. By protecting only the critical areas of the leg, the amount of protective material 120 used is minimized. This reduces manufacturing costs by using less of the expensive protective material 120 in the manufacture of the pants. As well, this minimizes coverage of the heavier, hotter, and less flexible protective material 120, thereby ensuring that the pants are as light, flexible, and breathable as possible.

It is worth noting that FIG. 4 also shows the protective material 120 having rounded edges. This improves the comfort of the pants and also uses less protective material, thereby reducing weight, cost, and heat. This also maximizes the proportion of the flexible material 110 used in the pants, which maximizes the stretch capabilities of the pants. As well, the avoidance of sharp corners in the protective material prevents stress points and weaknesses from developing in the pants as sharp corners may easily develop into points of failure.

Figure 5:
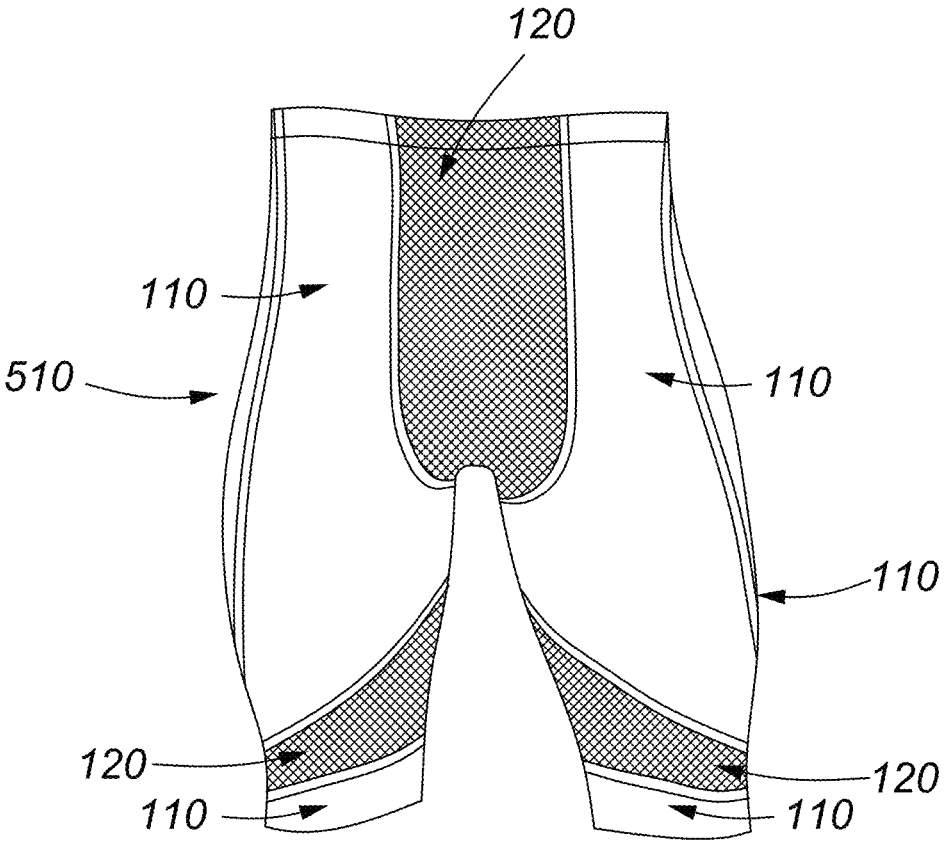
FIG. 5 is a front view of the protective pants according to yet another embodiment of the present invention.

FIG. 5 shows yet another embodiment of the present invention. In this embodiment of the invention, the lower portion of the pants is removed and only the upper portion 510 remains. This produces an embodiment of the present invention in the form of athletic shorts or short pants. The shorts are still comprised of flexible material 110 and protective material 120, and functions in substantially the same manner as the embodiments of the invention explained above. This embodiment of the present invention provides a lighter-weight, more flexible, but less protective, version of the pants. As can be seen from FIG. 5, the protective material covers the user's groin area and the region above the knee.

In another embodiment of the present invention, the pants include hook-and-loop fasteners on one side of each pants leg. This hook-and-loop fastener can be used to fasten hockey socks to the pants, thereby ensuring the socks do not fall down and cause discomfort to the user's feet.

As described above, the present invention aims to prevent injuries to critical areas, such as muscles, soft tissue, veins, and arteries of the lower body from lacerations or trauma as a result of sporting or workplace activity. As such, a person skilled in the art will understand that the use of the present invention would be equally applicable to hockey athletes as it would to manufacturing, military or law enforcement personnel. In the case of military or law enforcement personnel, the invention may be used to protect sensitive body areas from abrasion from surfaces or the environment, shards of glass, knives, or other sharp or edged objects. As noted above, the areas protected by the protective material may vary between the various uses contemplated for the invention. For law enforcement personnel, panels of the protective material may be placed to protect not just the groin area but the thigh area as well. There might not be as much danger to a user's calf muscles in law enforcement applications. As such, this region may not be protected by a protective material panel in pants designed for law enforcement uses.

A person skilled in the art will understand that the flexible material can be any material that has the preferred elasticity characteristic. For instance, the flexible material may be natural materials, such as cotton or wool, or synthetic materials, such as nylon polyester, or spandex, alternatively known as elastic polyurethane. Furthermore, the flexible material may be a composite material, composed of multiple natural and/or synthetic materials. As noted above, the flexible material may be Spandex or any other suitably flexible and elastic material.

For the protective material, panels made from various advanced fibers can be used. These advanced fibers can include any of the following: aramid fibers (e.g. Kevlar™ or Twaron™), Ultra-high-molecular-weight polyethylene (UHMWPE, UHMW) also known as high-modulus polyethylene (HMPE), and high-performance polyethylene (HPPE) such as Dyneema™ or Spectra™. In other applications, ballistic nylon and other bullet resistant fabrics or Cordura™ may also be used. Any protective material that is resistant to cutting, abrasion, or laceration but which is still flexible and which can be molded or shaped into the relevant shapes for the protective panels may be used with the invention. The protective material may be made from a high performance protective fabric, which is a composite material comprising at least 3%-5% elastic material, with the elastic material being spandex or any similar fiber. Preferably, the protective material can stretch in at least 2-dimensions, as opposed to having fibres placed in a manner that allows the material to stretch in a single dimension or achieves a degree of elasticity through mechanical stretch. However, protective material that only stretches in a single dimension may also be used in the present invention.

Although the ratio of protective material to flexible material will vary depending on the nature of the sport or industry, a preferred embodiment of the present invention includes 40-60% of the bottom portion of the leg (i.e. below the knee) to be covered by protective material. Similarly, in one embodiment it is preferred that 75-95% of the back area of the bottom portion of the leg (i.e. below the knee and including the knee) be covered by protective material or by a protective panel. Of course, other embodiments may use different percentages of coverage by the protective material or protective panel.

Additionally, it is preferred that the protective material covers at least 5-15% of the total upper leg area above the knee.

It should be noted that the coverage of the protective material is never 100% of the area as this would hamper the user's mobility and would simply result in pants that are 100% made from the protective material. A given percentage of the user's lower limbs may be covered by the protective panels made from the protective material. For the long pants version of the invention, the lower leg area (below the knees) may have up to 40-60% of the area covered by the protective panels. For the back of the lower leg area, up to 85% of the area may be covered by the protective material. The upper leg area (above the knee area) may have as much as 85% of the total area covered by protective panels.

It should also be understood that various embodiments of the present invention may incorporate a pouch for a protective cup to provide further protection to the groin and genital area of the wearer.

A person understanding this invention may now conceive of alternative structures and embodiments or variations of the above all of which are intended to fall within the scope of the invention as defined in the claims that follow.

What is claimed is:

1. A pair of protective pants comprising:

a front portion and a rear portion coupled to each other;

a waistband portion located at an upper end of the front portion and an upper end of the rear portion, the waistband portion forming an opening at a top side of the pair of protective pants;

a pair of elongated tubular pant legs extending downwardly from the waistband portion, each of the elongated tubular pant legs having an outer side, an inner side, and an open end opposite to the waistband portion, the outer side extending downwardly from the waistband portion and connecting to the open end, the inner side extending upwardly from the open end and connecting to the inner side of the other elongated tubular pant leg at a groin portion configured to cover a groin of a user;

the front portion of each of the elongated tubular pant legs further includes at least one of: a front thigh portion configured to cover a femoral artery of the user, a knee portion configured to cover a knee of the user, a shin portion configured to cover a shin of the user and a front ankle portion configured to cover an ankle of the user;

the rear portion of each of the elongated tubular pant legs further includes at least one of: a rear thigh portion configured to cover the femoral artery of the user, a hamstring portion configured to cover a hamstring of the user, a calf portion configured to cover a calf of the user and a rear ankle portion configured to cover an ankle of the user;

wherein the pair of protective pants is constructed from a flexible material and a protective material;

the protective material is affixed via seams to the flexible material as protective panels;

each seam of each protective panel is entirely directly adjacent to the flexible material;

at least one of:

where the rear portion includes the calf portion, the protective material covers between 75% and 95% of the calf portion;

where the rear portion includes the hamstring portion and the rear thigh portion, the protective material covers the hamstring portion, the rear thigh portion, and the groin portion;

where the front portion includes the front thigh portion and where the rear portion includes the hamstring portion, the protective material covers the hamstring portion, the front thigh portion, and the groin portion; and where the front portion includes the front thigh portion and where the rear portion includes the rear thigh portion, the protective material covers the front thigh portion, the rear thigh portion, and the groin portion;

the protective material is configured to adopt a shape that follows a muscle contour of the user when the user is wearing the pair of protective pants;

the protective material is a composite material comprising a first material and a second material, the first material having elasticity; the second material is selected from the group consisting of: aramid fibers, ultra-high-molecular-weight polyethylene, high-performance polyethylene, ballistic nylon, and bullet resistant fabric; and the flexible material is made from material selected from at least one of the group consisting of: natural fibers, elastic polyurethane, nylon, polyester and spandex.

2. The pair of protective pants as in claim 1, wherein the flexible material is formed as panels, and each protective panel is sandwiched between the panels of flexible material.

3. The pair of protective pants as in claim 1, wherein the pair of pants comprises a top portion, wherein the front portion includes the front thigh portion, and wherein the rear portion includes the rear thigh portion and the hamstring portion, wherein the top portion includes the groin portion, a right hip portion configured to cover a right hip of the user, a left hip portion configured to cover a left hip of the user, a buttocks portion configured to cover a buttocks of the user, the front thigh portion, the rear thigh portion and the hamstring portion, and wherein at least 5% of a surface area of the top portion comprises the protective material.

4. The pair of protective pants as in claim 1, wherein at least a portion of the protective material is in a lower portion of the pair of pants.

5. The pair of protective pants as in claim 4, wherein the front portion includes the knee portion, the shin portion and the front ankle portion, and wherein the rear portion includes the hamstring portion, the calf portion and the rear ankle portion, wherein the lower portion comprises the knee portion, the hamstring portion, the calf portion, the shin portion, the front ankle portion and the rear ankle portion.

6. The pair of protective pants as in claim 5, wherein 40% to 60% of a surface area of the lower portion comprises the protective material.

7. The pair of protective pants as in claim 1, wherein the front portion includes the front ankle portion and the rear portion includes the rear ankle portion, wherein the rear ankle portion comprises the protective material, a right side of the front ankle portion comprises the protective material, and a left side of the front ankle portion comprises the protective material.

8. The pair of protective pants as in claim 7, wherein a front side of the front ankle portion is composed of the flexible material.

9. The pair of protective pants as in claim 1, wherein the front portion includes the knee portion and the rear portion includes the hamstring portion, wherein the knee portion and the hamstring portion comprises the protective material.

10. The pair of protective pants as in claim 1, wherein the front portion includes the front thigh portion and the rear portion includes the hamstring portion, the rear thigh portion, and the calf portion, wherein the hamstring portion comprises the protective material, the front thigh portion comprises the protective material, the rear thigh portion comprises the protective material, and between 75% and 95% of the calf portion comprises the protective material.

11. The pair of protective pants as in claim 1, further including at least one hook-and-loop fastener being affixed to a remainder of the pair of pants for operatively coupling the pair of pants to an independent garment.

12. The pair of protective pants as in claim 1, wherein the groin portion further comprises a pouch for use with a protective cup support.

13. A pair of protective pants comprising:

a front portion and a rear portion coupled to each other;

a waistband portion located at an upper end of the front portion and an upper end of the rear portion, the waistband portion forming an opening at a top side of the pair of protective pants;

a pair of elongated tubular pant legs extending downwardly from the waistband portion, each of the elongated tubular pant legs having an outer side, an inner side, and an open end opposite to the waistband portion, the outer side extending downwardly from the waistband portion and connecting to the open end, the inner side extending upwardly from the open end and connecting to the inner side of the other elongated tubular pant leg at a groin portion configured to cover a groin of a user;

the front portion of each of the elongated tubular pant legs further includes at least one of: a front thigh portion configured to cover a femoral artery of the user, a knee portion configured to cover a knee of the user, a shin portion configured to cover a shin of the user and a front ankle portion configured to cover an ankle of the user;

the rear portion of each of the elongated tubular pant legs further includes at least one of: a rear thigh portion configured to cover the femoral artery of the user, a hamstring portion configured to cover a hamstring of the user, a calf portion configured to cover a calf of the user and a rear ankle portion configured to cover an ankle of the user;

wherein the pair of protective pants is constructed from a flexible material and a protective material;

the protective material is affixed via seams to the flexible material as protective panels;

each seam of each protective panel is entirely directly adjacent to the flexible material;

at least one of:

where the rear portion includes the calf portion, the protective material covers between 75% and 95% of the calf portion;

where the rear portion includes the hamstring portion and the rear thigh portion, the protective material covers the hamstring portion, the rear thigh portion, and the groin portion;

where the front portion includes the front thigh portion and where the rear portion includes the hamstring portion, the protective material covers the hamstring portion, the front thigh portion, and the groin portion; and where the front portion includes the front thigh portion and where the rear portion includes the rear thigh portion, the protective material covers the front thigh portion, the rear thigh portion, and the groin portion;

the protective material being configured to adopt a shape that follows a muscle contour of the user when the user is wearing the pair of protective pants;

the protective material is selected from the group consisting of: aramid fibers, ultra-high-molecular-weight polyethylene, high-performance polyethylene, ballistic nylon, and bullet resistant fabric; and the flexible material is made from material selected from at least one of the group consisting of: natural fibers, elastic polyurethane, nylon, polyester and spandex.

* * * * *